US011187220B2

(12) United States Patent
Bassine

(10) Patent No.: US 11,187,220 B2
(45) Date of Patent: Nov. 30, 2021

(54) COMPRESSOR FOR PRESSURIZED FLUID OUTPUT

(71) Applicant: Stuart H. Bassine, Butler, TN (US)

(72) Inventor: Stuart H. Bassine, Butler, TN (US)

( * ) Notice: Subject to any disclaimer, the term of this patent is extended or adjusted under 35 U.S.C. 154(b) by 855 days.

(21) Appl. No.: 14/370,707

(22) PCT Filed: Jan. 14, 2013

(86) PCT No.: PCT/US2013/021394
§ 371 (c)(1),
(2) Date: Jul. 3, 2014

(87) PCT Pub. No.: WO2013/106810
PCT Pub. Date: Jul. 18, 2013

(65) Prior Publication Data

US 2014/0369873 A1 Dec. 18, 2014

Related U.S. Application Data

(60) Provisional application No. 61/585,282, filed on Jan. 12, 2012.

(51) Int. Cl.
*F04B 27/10* (2006.01)
*F04B 9/04* (2006.01)
(Continued)

(52) U.S. Cl.
CPC ..... *F04B 27/1063* (2013.01); *F04B 1/0413* (2013.01); *F04B 9/047* (2013.01);
(Continued)

(58) Field of Classification Search
CPC .... F01B 7/16; F01B 9/06; F01B 9/023; F01B 9/026; F01B 1/0658; F01B 1/0648;
(Continued)

(56) References Cited

U.S. PATENT DOCUMENTS 1,336,846 A * 4/1920 Lewis ..... F02B 57/08
123/44 D
1,503,540 A * 8/1924 Lawhead ..... F04B 27/02
417/254

(Continued)

FOREIGN PATENT DOCUMENTS

DE 25 57 811 A1 6/1977
DE 100 55 445 C1 8/2002

(Continued)

OTHER PUBLICATIONS

Supplementary European Search Report in corresponding European application No. EP 13 73 6400, dated Oct. 21, 2015.

*Primary Examiner* — Kenneth Bomberg
*Assistant Examiner* — Michael Quandt
(74) *Attorney, Agent, or Firm* — Luedeka Neely Group, PC

(57) ABSTRACT

A compressor moves a fluid from an inlet to an outlet and provides a pressure differential there between due to respective pistons moving in and out of a plurality of piston chambers via a piston rod. A rotating shaft extends through a grooved end plate, and the rotating shaft is connected to either the grooved end plate or the piston rod. The grooved end plate defines an off center or eccentric groove. A bearing extends from the piston rod and fits within the groove such that when the rotational motion of the shaft rotates either the piston rod or the grooved end plate, the piston rod slides back and forth relative to the rotating shaft. Each position of the bearing within the groove determines a corresponding position of the piston rod relative to the rotating shaft. Each pair of pistons may extend from a single, continuous piston rod.

9 Claims, 12 Drawing Sheets

(51) Int. Cl.
*F04B 1/0413* (2020.01)
*F04B 27/00* (2006.01)
*F04B 27/02* (2006.01)
*F04B 1/02* (2006.01)

(52) U.S. Cl.
CPC ..... *F04B 1/02* (2013.01); *F04B 27/005* (2013.01); *F04B 27/02* (2013.01)

(58) Field of Classification Search
CPC ..... F01B 2009/063; F04B 1/0413; F04B 39/0094; F04B 43/006; F04B 27/1063; F04B 27/02; F04B 9/047; F16J 1/12; F16H 21/36; F16H 53/02; F16H 25/14; Y10T 74/18296
See application file for complete search history.

(56) References Cited

U.S. PATENT DOCUMENTS 1,748,443 A * 2/1930 Dawson ..... F16H 25/14 123/54.3
3,002,504 A * 10/1961 Taylor ..... F01B 1/062 91/174
3,216,355 A * 11/1965 Wanner ..... F04B 1/02 417/536
3,300,997 A * 1/1967 Kocher ..... F25B 31/00 62/117
3,680,444 A * 8/1972 Casey ..... F01B 1/0668 91/493
4,038,949 A * 8/1977 Farris ..... F01B 13/068 123/44 C
4,443,163 A 4/1984 Gaither
5,076,769 A 12/1991 Shao
6,162,030 A 12/2000 Pierrat
6,283,723 B1 9/2001 Milburn et al.
7,475,627 B2 * 1/2009 Irick ..... F01B 9/023 417/534
2007/0258831 A1 11/2007 Irick

FOREIGN PATENT DOCUMENTS

GB 191319203 A * 8/1914 ..... F02B 57/08
GB 2421981 A 7/2006
JP 2000-064953 A 3/2000

* cited by examiner

COMPRESSOR FOR PRESSURIZED FLUID OUTPUT

CROSS REFERENCE TO RELATED APPLICATIONS

This application claims priority to and incorporates entirely by reference herein U.S. Provisional Patent Application Ser. No. 61/585,828 filed on Jan. 12, 2012.

FIELD OF THE INVENTION

The invention relates to the field of gas compressors that have an input for a gas and an output for the gas, wherein the gas has an adjusted pressure at the output due to the operation of pistons within the compressor.

BACKGROUND

Compressors for air, gas, and fluid movement are in constant need for the medical, automotive and beverage industries, just to name a few. Piston pumps are well known in the area of compressors. Piston pumps traditionally include a rotating shaft having a concentric attached with a piston moving up and down (i.e., reciprocating). One version of a piston pump is a wobble piston pump (FIG. 1) and has the piston rod (20) attached to the piston (18) on one end and an eccentric bearing assembly (25) on the opposite end. As a rotating shaft (23) rotates about the bearing assembly (25), piston rod (20) changes positions (as shown in the dotted lines of FIG. 1) and causes the piston (18) to shift up and down from one side to the other (i.e., the piston "wobbles") The piston (18) rocks up an down from left to right and uses a Teflon seal or cup (14) to apply pressure to opposite sides (16A, 16B) of a chamber (17) such that one side of the chamber creates a vacuum (e.g., an inlet (10)) and one side of the chamber creates positively pressurized displacement (e.g., outlet (12)). These pumps have limited up and down travel and displacement and are good for pressure adjustment, but for volume they have a short compression stroke and displacement size per revolution. They are not efficient in total volume of air/gas movement due to limited piston travel and displacement. More compressor heads may be added but more space and weight is required. These compressors are noisy, have a lot of vibration, and are heavy due to the metal concentric needed as part of the assembly. Wobble pistons offer limited air volume when considering size and weight. The Teflon piston is reliable; however, per revolution volume is low and efficiency is poor when total volume of air/gas moved is considered vs. power consumed. They also have a pulsing flow, not a smooth output flow. Rocking back and forth, they tend to pull air from around the end of the piston instead of through the intake, thus there is a contamination problem.

Another kind of prior art compressor includes a rotary vane pump (FIG. 2). As shown by the image of a Gast® compressor in FIG. 2, the compressor includes a rotating shaft in an off center, or "eccentric" position with respect to the interior of the compressor. Piston rods (40) connect sliding vanes (42) to chambers (43), and the eccentric position of the rotary shaft provides different travel lengths for the vanes to slide inwardly and outwardly at positions about an inner circumference (45) of the compressor. As the space within the compressor is available to allow the vanes to thrust outward (e.g., vane (42B)), a vacuum is created in the piston chamber (43) and as the vanes are pushed back in (i.e., vane position 42(D)), fluid or air or gases collected in the piston chamber (43) are compressed within the respective chamber (43)). The compressed gases or fluids within a chamber (42) are allowed to exit at an outlet (31) with a higher pressure than that found at the inlet (30) of the compressor. Rotary vane pumps often utilize carbon vanes with compressor bodies made of steel. These materials have low thermal expansion and are required because of very close tolerance for spacing. These compressors offer high volumes of air per revolution due to the opportunity for using multiple vanes. They are not for high pressure. These rotary vane compressors are very heavy and have a carbon dust problem and tend to wear out (vanes) quickly and must have costly machining due to close tolerances. They do move high volumes of air. The rotary compressor is quiet, has low vibration and is not designed for high pressure when oil-less they and wear out quickly but have a smooth non-pulsating output flow.

Compressors in many industrial environments would benefit from better efficiencies in allowing for multiple pistons driven by common shafts with less duplication in parts and therefore lighter weight assemblies.

BRIEF SUMMARY OF THE INVENTION

In one embodiment, a compressor for moving a gas from an inlet to an outlet provides a pressure differential between the inlet and the outlet due to respective pistons moving in and out of a plurality of piston chambers. A rotating shaft extends in a first direction through a grooved end plate extending across the compressor in a second direction substantially perpendicular to the rotating shaft, and the rotating shaft is connected to either the grooved end plate or the piston rod. The grooved end plate defines a substantially circular groove positioned off center with respect to the shaft, and a piston rod extends through the compressor substantially perpendicular to the rotating shaft. The piston rod slides back and forth relative to the rotating shaft such that the respective pistons are alternately closer to and farther from the rotating shaft. The compressor further includes a bearing extending from the piston rod and fitting within the groove in the first end plate such that when the rotational motion of the shaft rotates either the piston rod or the first end plate, the bearing traverses the groove in the first end plate. Each position of the bearing within the groove determines a corresponding position of the piston rod relative to the rotating shaft.

In a different embodiment, a compressor moves a gas from an inlet to an outlet and provides a pressure differential between the inlet and the outlet. The compressor includes a rotating shaft extending in a first direction through the compressor and a piston rod extending through the compressor in a second direction substantially perpendicular to the rotating shaft. The piston rod connects respective pistons at opposite ends of the piston rod, and the piston rod slides back and forth relative to the rotating shaft such that said respective pistons are alternately closer to and farther from said rotating shaft. A bearing extends from the piston rod, and a grooved end plate extends substantially parallel to the piston rod. The grooved plate defines a groove that receives the bearing therein, wherein the groove within the grooved end plate is off-center with respect to the shaft. The bearing traverses the groove when the rotational motion of the shaft rotates either the piston rod or the grooved end plate. Each position of the bearing within the groove determines a corresponding position of the piston rod relative to the rotating shaft.

DETAILED DESCRIPTION

Figure 1:
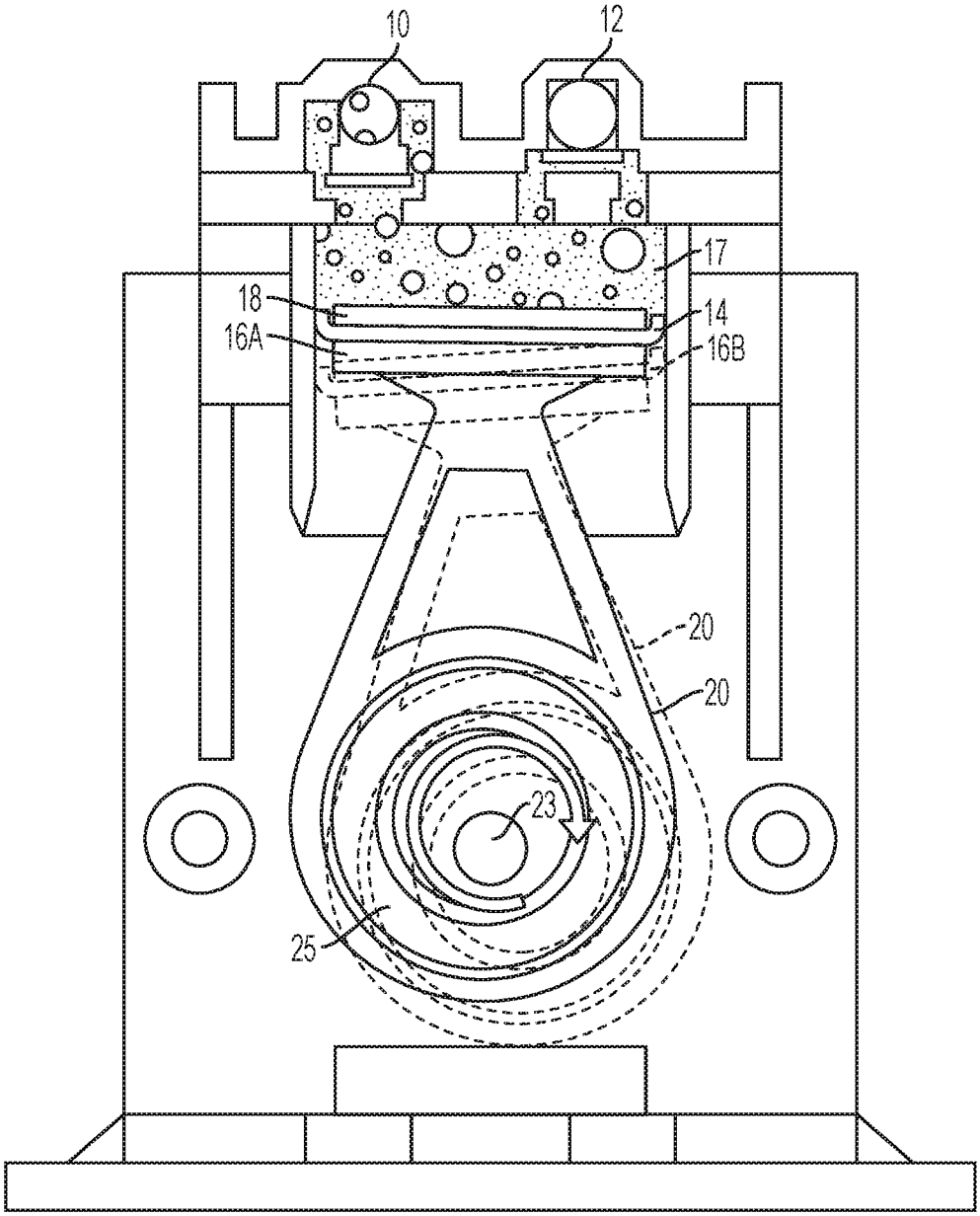
FIG. 1 PRIOR ART
FIG. 1 is a front plan view of a prior art wobble piston compressor.
Figure 2:
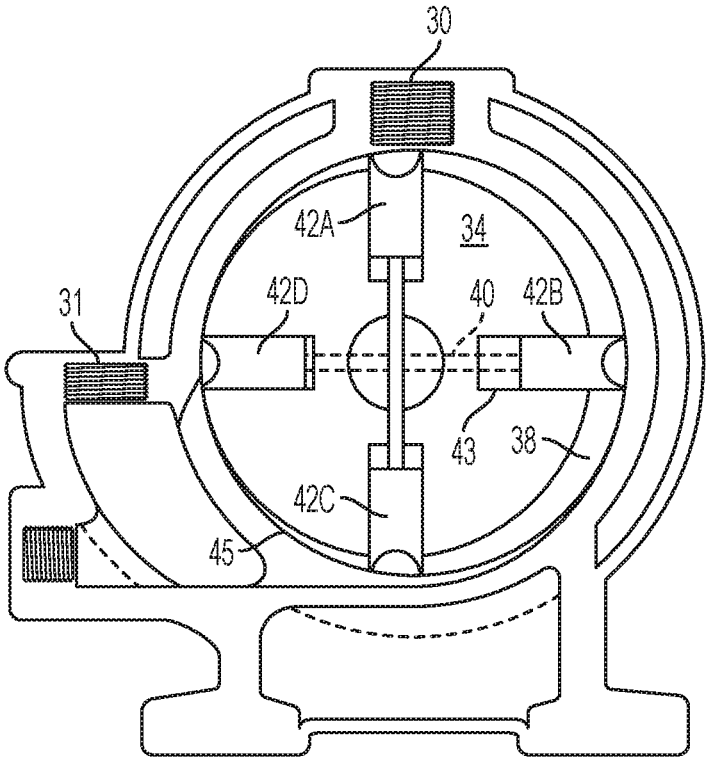
FIG. 2 PRIOR ART
FIG. 2 is a front plan view of a prior art rotary vane compressor.
Figure 3A:
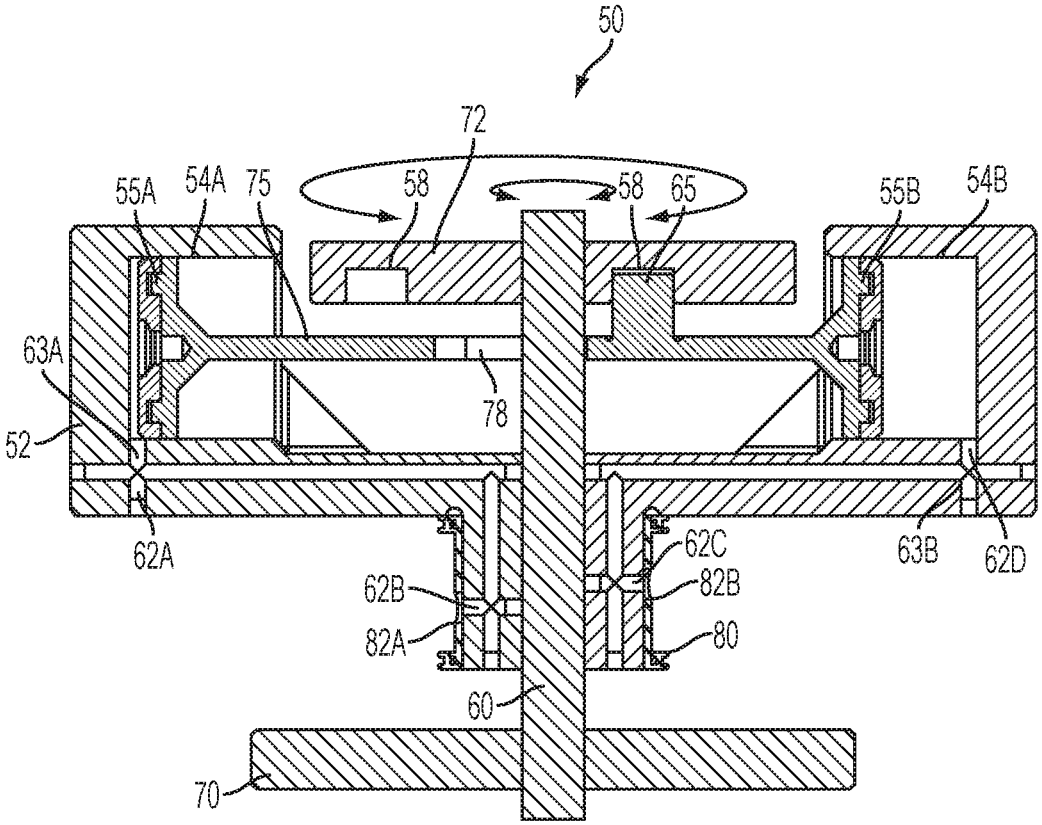
FIG. 3A is a plan cross sectional view of a compressor as described herein.
Figure 3B:
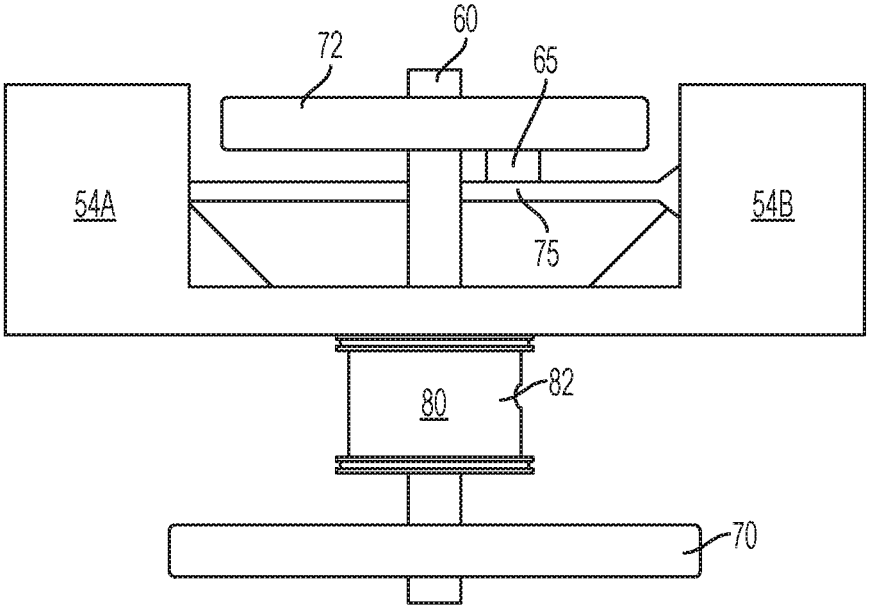
FIG. 3B is a plan view of the compressor of FIG. 3A.
Figure 3C:
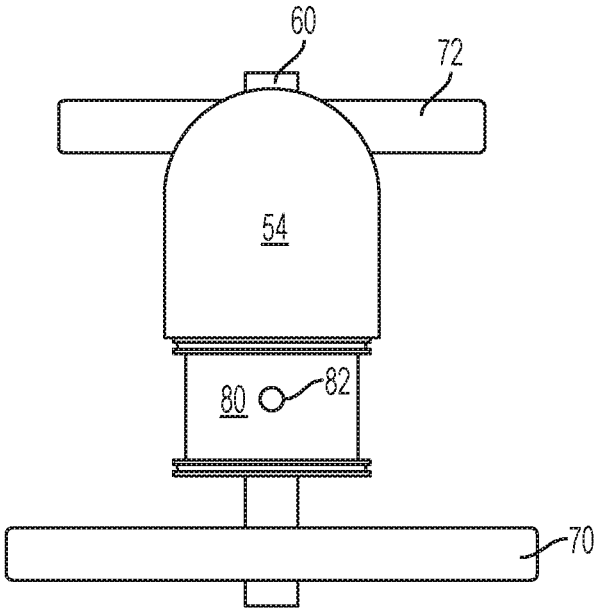
FIG. 3C is a side view of the compressor of FIG. 3A.

FIGS. 3A to 3C included herein illustrate a compressor that is useful for compressing air, specific gases (e.g., oxygen compression), or even fluids. The term "fluids" is used in its broadest sense to encompass any matter that flows and can be subject to pressure, whether in gaseous or liquid form. In that regard, the compressor may be referred to as a fluid compressor, an oxygen compressor, or an air compressor because the nature of the medium being compressed does not change the structure of the invention claimed herein.

The compressor of FIG. 3A shows an overview of one embodiment of the invention. The compressor (50) incorporates a base end plate (70) extending across the compressor (50) and allowing a rotating shaft (60) to extend there through. The rotating shaft (50) is connected to a power source delivering rotational energy in standard mechanical embodiments that are not shown in the art (e.g., motors driving the rotating shaft). The rotating shaft (60) can rotate in either a forward or reverse direction, depending on the desired orientation for an inlet and outlet of compressed gases or fluids.

In one embodiment, the rotating shaft (60) extends through the compressor (50) in a vertical orientation when the base end plate (70) crosses the compressor (50) in a substantially horizontal configuration. The rotating shaft (60) extends from the base end plate (70) through the compressor body (52) and terminates at or near a grooved end plate (72). The grooved end plate (72) is characterized in part by defining a groove (58), which in one embodiment is a substantially circular groove (58). The circular nature of the groove (58), however, is not limiting of the invention, and the groove (58) may take any shape that affords the convenience of providing a track for guiding pistons within the compressor. In one embodiment that does not limit the invention, the groove (58) may include elliptical or oblong shapes or have portions of the groove (58) that define straight segments instead of arcuate paths.

The groove (58) in the grooved end plate (72) is configured to receive a bearing (65) that adjusts the position of associated pistons (55A, 55B) by traversing the stationary groove (58). In the alternative, the groove (58) may traverse a stationary bearing (65). In other words, the rotating shaft (60) may be attached to the grooved end plate (72) and impart rotational energy to the grooved end plate (72) so that the groove (58) moves about a bearing (65).

In one non-limiting embodiment of the compressor (50), the bearing (65) is attached to a piston rod (75) that terminates on opposite ends with respective pistons (55A, 55B). The pistons (55A, 55B) move back and forth within piston chambers (54A, 54B). In this regard, the compressor (50) accommodates a sliding lateral movement by the piston rod (75), and the position is determined by the forces acting upon the bearing (65) attached to the piston rod (75). In one embodiment, the piston rod (75) is a single, continuous piston rod with no breaks or interruptions along the length between the pistons (55A, 55B). The piston chambers (54A, 54B) are sized to provide appropriate space for the pistons to move back and forth.

In the embodiment of FIG. 3A, the piston rod (75) defines an opening (78) (also shown in FIGS. 5A and 5B) through which the rotating shaft (60) extends; the rotating shaft (60) continues through the piston rod (75) to the grooved end plate (72). Depending upon the embodiment at hand, the rotating shaft (60) may be physically connected to either the piston rod (75) or the grooved end plate (72) and impart rotational motion to either. The rotational motion from the rotating shaft (60), applied to the piston rod (75), allows the bearing (65) to traverse the groove (58) in the grooved end plate (72). When the rotational motion from the rotating shaft (60) is applied to grooved end plate (72), the grooved end plate actually turns so that the groove (58) actually traverses the bearing (65). Whether the rotating shaft (60) attaches and imparts rotational motion to the piston rod (75) or the grooved end plate (72), the result is that the groove (58) determines the rotational forces on the bearing (65) that in turn applies forces to the piston rod (75).

As shown by the arrows of FIG. 3A, when the rotating shaft (60) is connected to the grooved end plate (72) and thereby turns the grooved end plate along with the groove (58), the bearing (65) attached to the piston rod (75) determines whether the piston rod (75) slides laterally back and forth. The position of the bearing (65) within the groove (58) will determine the extent to which the piston rod (72) slides along the opening (78) defined within the piston rod (72).

As an example, FIG. 3A shows the grooved end plate (72) turning with the bearing (65) within the "eccentric" or "off-center" groove (58). In this regard, the term "eccentric" or "off-center" means that the center of the groove (58) is not identical with the vertical axis of the compressor or the rotating shaft (60). The eccentric groove (58) allows the bearing to adjust the lateral position of the piston rod (75) because as the bearing (65) traverses the groove (58), or the groove (58) slides over the bearing (65), the orientation of the groove and bearing contact pushes the associated piston rod in a lateral, or horizontal direction. In the embodiment of FIG. 3A, when the grooved end plate (72) rotates the groove over the bearing (65), the groove pushes the bearing and the bearing pushes the piston rod (75). The piston rod in this embodiment will slide back and forth with the pistons moving an equal amount within the piston chambers.

In a different scenario, when the rotating shaft (60) turns the piston rod (75) so that the piston rod swings outwardly in a circular pattern, the bearing moving within the groove continuously changes the lateral position of the pistons in relation to the rotating shaft.

In either set up, whether the piston rod rotates in a horizontal plane and slides back and forth continuously as the bearing traverses the groove, or whether the grooved end plate rotates in a second horizontal plane so that the stationary bearing (65) pushes the piston rod back and forth, the result is that the pistons (55A, 55B) are alternately positioned closer to and farther from the rotating shaft. As a piston moves closer to the rotating shaft and out of an associated piston chamber, a vacuum is created in the piston chamber. As the piston moves farther away from the rotating shaft and deeper into the piston chamber, gases or fluids in the chamber are compressed by the piston. FIG. 3A shows a network of ports (62A-62D) connecting the piston chambers with appropriate inlets (62D) and outlets (62A) within the device. Properly oriented valves (63A, 63B) may be utilized to ensure proper input and output flow from the piston chambers (54A, 54B), respectively. The network of ports may be bored into the body of the compressor (50) by known means. The porting (62A-62D) is normally designed into the stationary portion of the compressor (50) so that outside instruments or attachments can utilize the compressed fluid on the outlet side.

Figure 4:
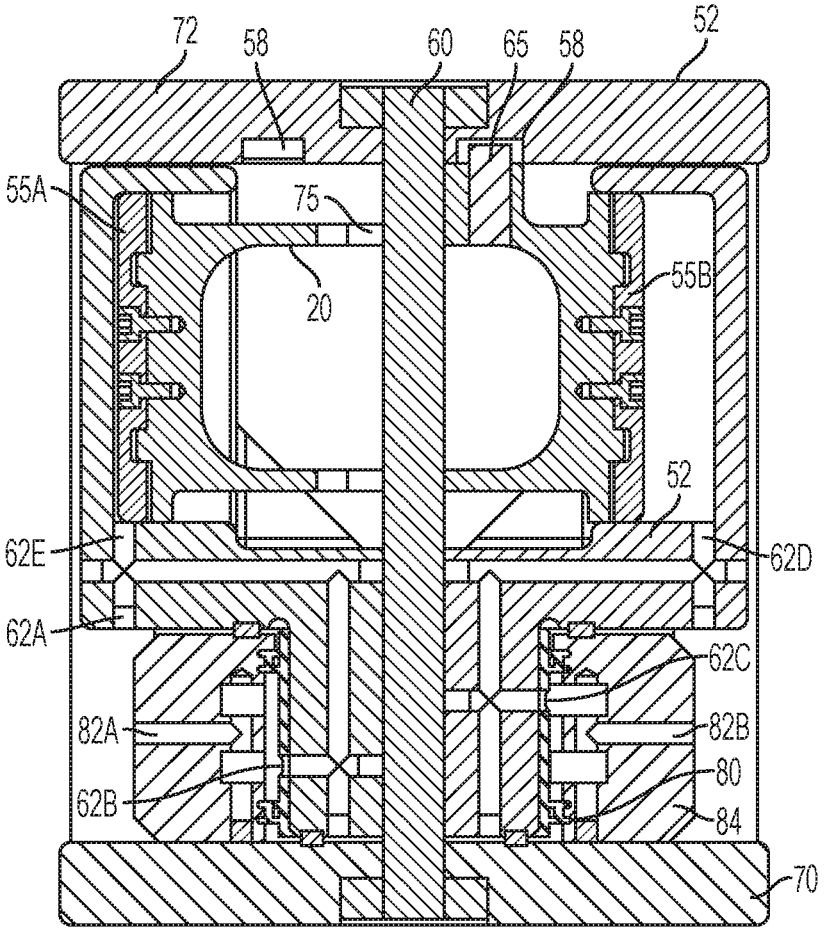
FIG. 4 is a side cross sectional view of another compressor embodiment.

FIGS. 3A-3C also show a lip seal (80) surrounding the porting section (62B, 62C) of the compressor (50). In one embodiment, the seal for the porting is a lip seal (80). FIGS. 3B and 3C show the different perspectives of the compressor (50) along with the output ports for the seal (80). The seal body (84) is shown even more clearly in FIG. 4. In the drawing of FIG. 4, the seal body (84) surrounds a portion of the compressor (50) proximate the base end plate (70) and surrounds a portion of the rotating shaft (60) between the base end plate (70) and the piston rod (75). The ports (62A-62D) defined within the compressor body (52) match the corresponding ports (82A, 82B) of the seal.

Figure 5A:
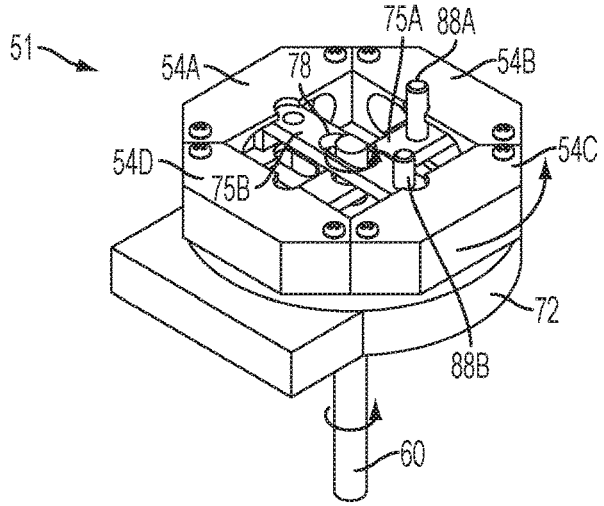
FIG. 5A is a perspective view of a dual piston rod compressor as described herein.
Figure 5B:
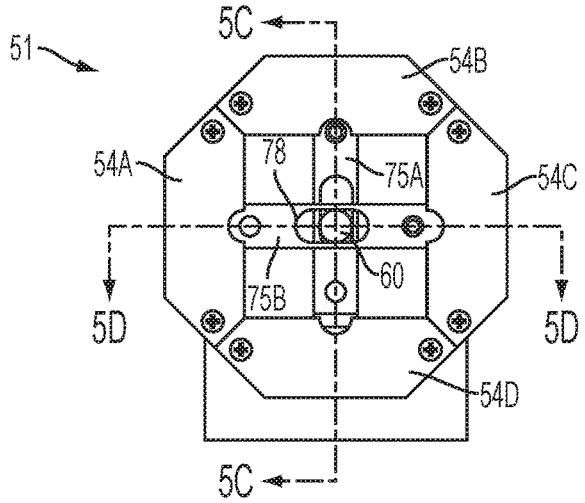
FIG. 5B is a top view of the dual piston rod compressor of FIG. 5A.
Figure 5C:
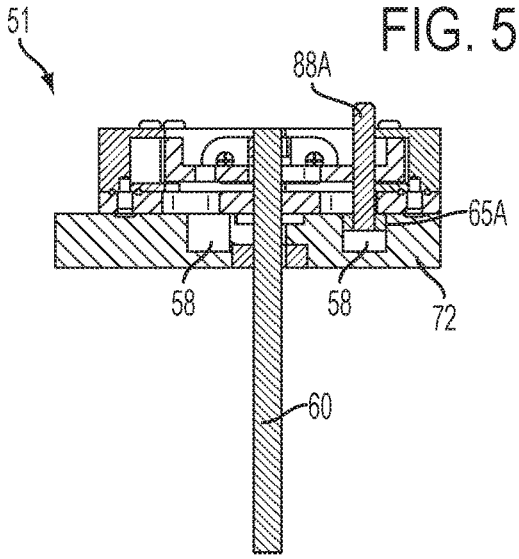
FIG. 5C is a side cross sectional view of the dual piston rod compressor as viewed along the line 5C-5C of FIG. 5B.
Figure 5D:
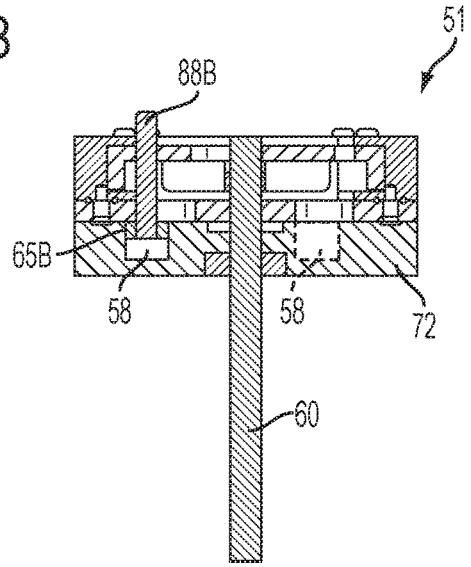
FIG. 5D is a second side cross section view of the dual piston rod compressor as viewed along the line 5D-5D of FIG. 5B.

The embodiment of FIG. 3 may also be expanded to the embodiment of FIGS. 5A-5D, showing that the compressor may incorporate more than one piston rod and more than one set of pistons within the same device. The compressor (51) includes dual piston rods (75A, 75B) which operate upon the same principles discussed above in regard to FIG. 3. The piston rods (75A, 75B) include a respective pins (88A, 88B) and bearings (65A, 65B) that engage a single groove (58) within a grooved end plate (72). Each piston rod, of course, terminates in opposite pistons with respective piston chambers. As shown in FIG. 5A, the rotating shaft (60) turns the dual piston rods (75A, 75B) simultaneously so that each traverses the same groove (58). In the embodiment of FIG. 5, the piston rods (75A, 75B) are positioned such that on is on top of the other, but this embodiment is for illustration purposes only. As shown in the Figures, the piston chambers (54A-54D) are all at equal heights, so the pistons terminating a top piston rod (75B) would be adjusted in height to fit an appropriate piston chamber that is level will all other piston chambers.

Figure 6:
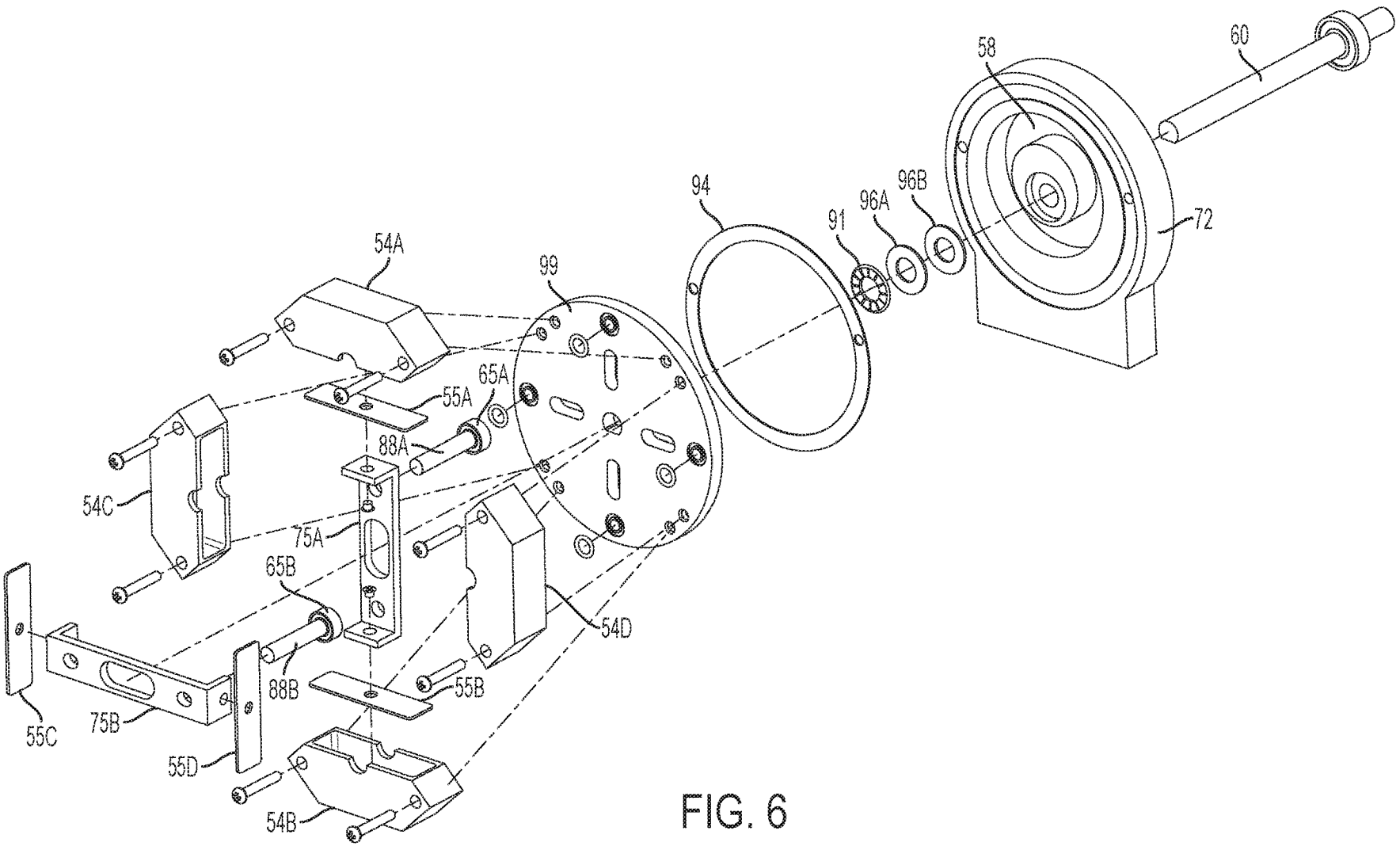
FIG. 6 is an exploded view of a dual piston compressor having four pistons as described herein.

FIG. 6 shows one example of an exploded view of a compressor according to FIGS. 5A-5D utilizing dual piston rods (75A, 75B) reciprocated by pins (88A, 88B) and bearings (65A, 65B) that engage the groove (68). FIG. 6 illustrates that the orientation of the components of the compressor may be adjusted for the use at hand. In the embodiment of FIG. 6, the rotating shaft (60) fits through the eccentrically grooved end plate (72) and passes through washers (91, 96A, 96B) as well as housing gasket (94). The end of the rotating shaft (60) is flattened and engages a central aperture of a circular rotating plate (99) so as to drive the plate (99) in rotation, the central aperture being generally circular but having a flat portion (towards the bottom in the orientation of FIG. 6) corresponding to the flattened end of the rotating shaft (66). The piston chambers (54A, 54B) and (54C, 54D) are mounted to rotating plate (99). Thus the piston chambers (54A, 54B) and (54C, 54D) rotate, and accordingly the pistons (55A, 55B) and (54C, 54D) and the rods (75A, 75B) also rotate. The pistons (55A-55D) move back and forth within the piston chambers (54A-54D), due to the bearings (65A, 65B) (referenced in FIGS. 5A-5D) attached to the rods (74A, 75B) engaging the groove (58) in the end plate (72), which is stationary. The rotating plate 99) also includes appropriate ports and seals.

Figure 7:
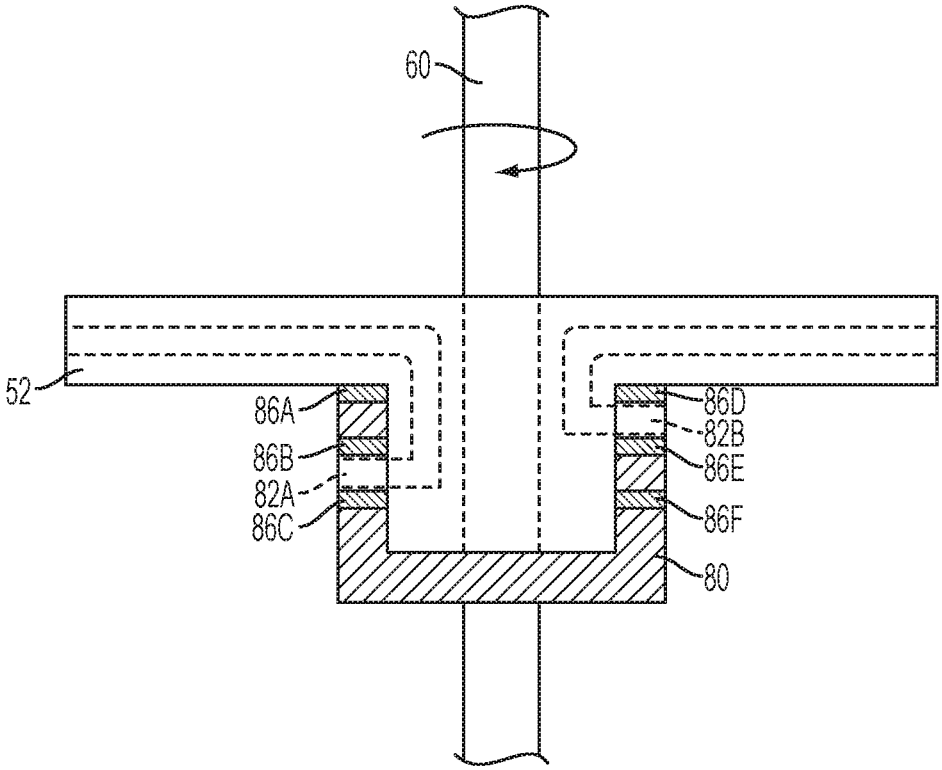
FIG. 7 is a cross section view of a compressor as described herein and having a lip seal matching inlet and outlet ports.

FIGS. 7-10 illustrate methods of developing port networks within the body of a compressor and providing an appropriate seal therein. The porting may be either individualized with each piston chamber having a discrete set of input and output ports, or the porting may be combinable so that a given set of ports serves more than one piston chamber. FIG. 7 illustrates that the compressor body (52) extends around the rotating shaft (60) and includes appropriate input and output ports (82A, 82B). The lip seal (80) includes proper lip seal elements (86A-86F) to ensure that peripheral equipment has access to the porting network with no loss of efficiency in terms of flow rate or pressure differential.

Figure 8:
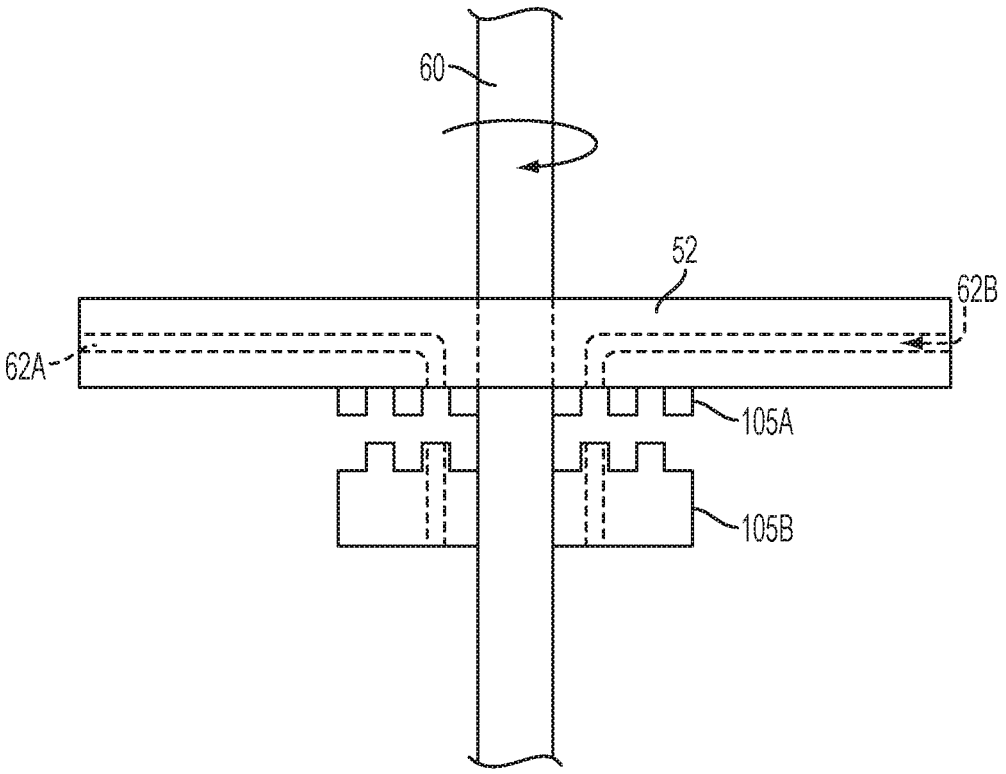
FIG. 8 is a cross section view of a compressor as described herein and having a labyrinth seal matching inlet and outlet ports.

FIG. 8 illustrates a labyrinth seal (105A, 105B) as another option for sealing the ports (62A, 62B). The labyrinth seal (105) may include dual portions (105A, 105B) that fit together to allow the input and output ports to maintain maximum efficiency in operation.

Figure 9:
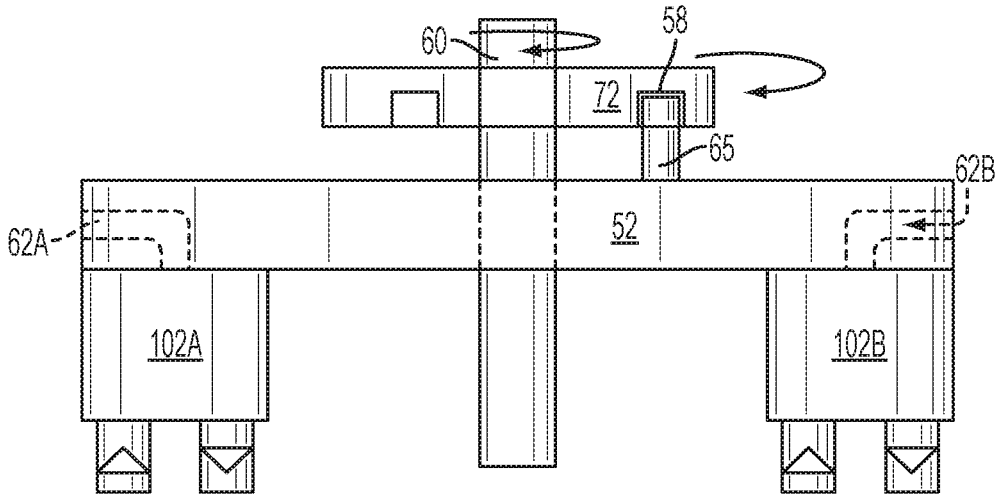
FIG. 9 is a cross section view of a compressor as described herein and having a check valves configured to match inlet and outlet ports.
Figure 10A:
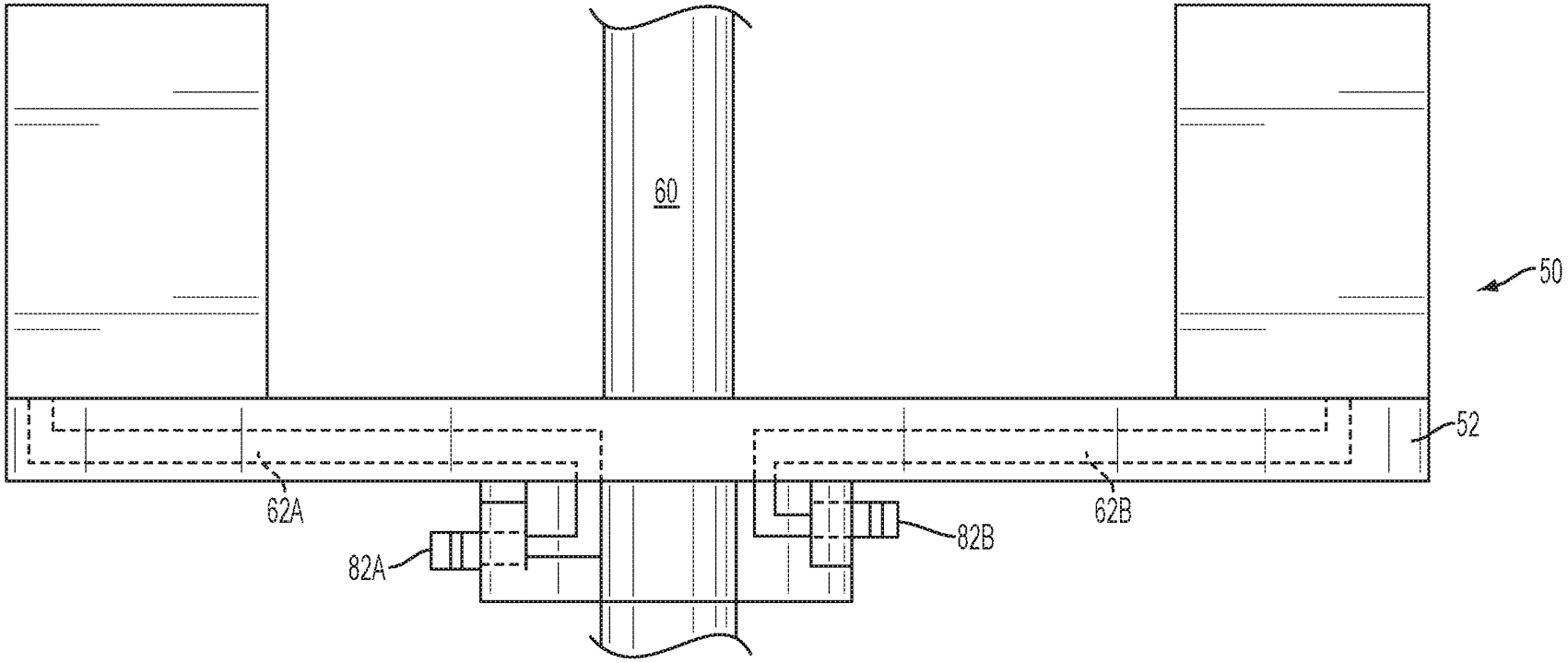
FIG. 10A is a cross section view of a compressor as described herein and having inlet and outlet ports on opposite sides of an associated seal.
Figure 10B:
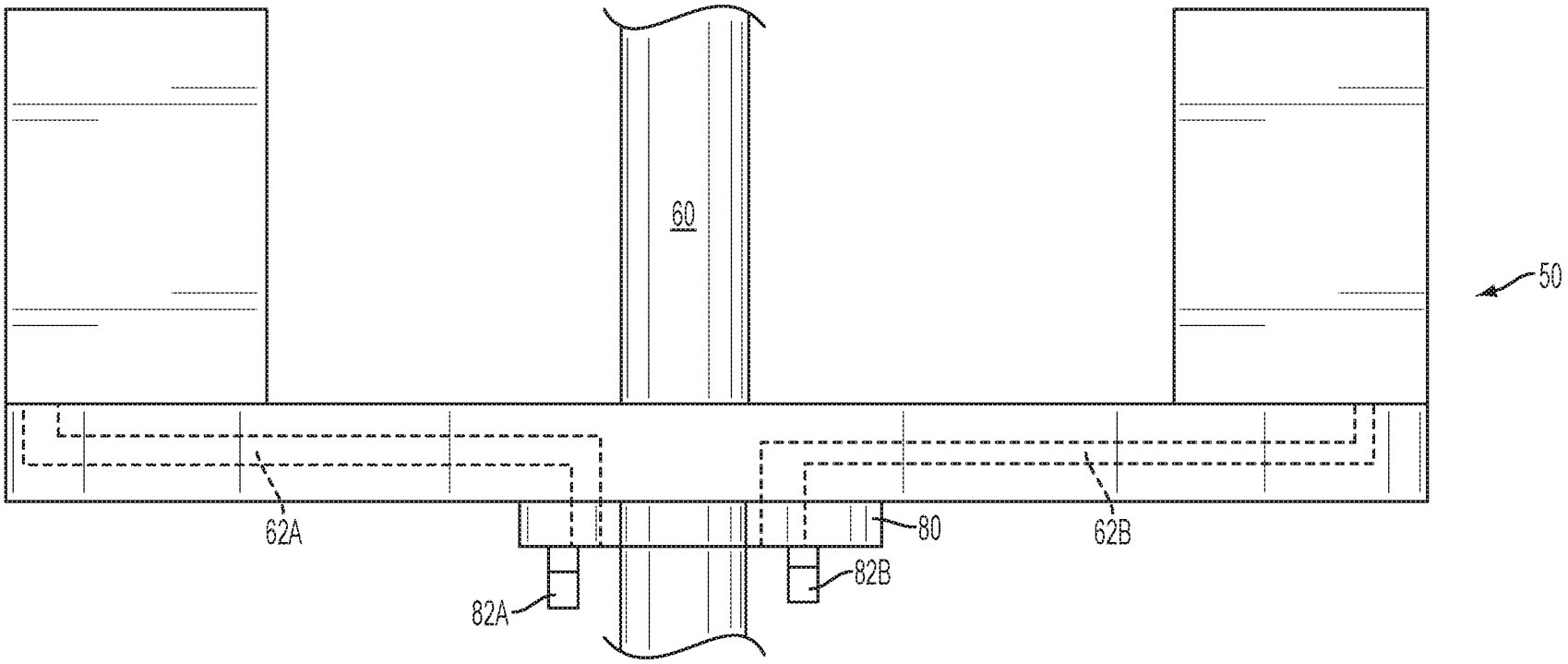
FIG. 10B is a cross section view of a compressor as described herein and having inlet and outlet ports on the bottom side of an associated seal.

FIG. 9 shows that the ports may be managed by appropriate check valves, while FIGS. 10A and 10B illustrate numerous locations for the ports on both the compressor body and the associated seal.

The materials used in forming the compressor described above, may include Teflon® or Rulon® piston seals or other slippery, low friction piston seals which are self-entering and floating and maintain the alignment of the piston. The seals may be dual facing. The body of the compressor, the piston rods, the pistons, and the plates within the compressor may be made of durable materials, such as low carbon steels, aluminum, and even polymeric synthetic materials. The appropriate materials can be selected for both the compressor and the associated seals to minimize or at least control thermal expansion of the components during use.

While specific embodiments of the invention have are illustrated and described herein, it is realized that numerous modifications and changes will occur to those skilled in the art. It is therefore to be understood that the appended claims are intended to cover all such modifications and changes that fall within the true spirit and scope of the invention.

What is claimed is:

1. A compressor for moving a gas from an inlet to an outlet and providing a pressure differential between the inlet and the outlet, the compressor comprising:

a pair of piston chambers;

at least a first piston rod connecting a first pair of pistons at opposite ends of said at least a first piston rod, said pistons reciprocating within said piston chambers, said at least a first piston rod supported solely by said pistons and moving back and forth on the same axis;

a single bearing extending from and supported by said at least a first piston rod;

a rotating shaft;

a grooved end plate defining a groove which is off center with reference to said rotating shaft and not symmetrical with reference to said rotating shaft; and said rotating shaft connected so as to rotate either said piston chambers and accordingly said pistons and said at least a first piston rod or said grooved end plate, said at least a first piston rod being perpendicular to said rotating shaft, said grooved end plate being perpendicular to said rotating shaft;

said single bearing received in said groove such that, when rotational motion of said shaft rotates either said at least a first piston rod or said grooved end plate around said shaft, each position of said single bearing within said groove determines a corresponding position of said at least a first piston rod relative to said rotating shaft.

2. The compressor according to claim 1, wherein the rotational motion rotates the piston rod around said shaft along a path that is parallel to the grooved end plate such that the respective pistons advance and retract within respective piston chambers as the piston rod slides back and forth about the rotating shaft.

3. The compressor according to claim 1, wherein the rotating shaft rotates the piston rod around said shaft within a plane that is perpendicular to the rotating shaft, and said bearing traverses the groove as the piston rod rotates, wherein the piston rod slides about the rotating shaft within an opening in the piston rod as the position of the bearing within the groove changes.

4. The compressor according to claim 1, wherein said at least a first piston rod defines an opening through which said rotating shaft extends.

5. The compressor according to claim 4, wherein the rotating shaft is connected to the grooved end plate and imparts rotational motion to the grooved end plate.

6. A compressor for moving a gas from an inlet to an outlet and providing a pressure differential between the inlet and the outlet, the compressor comprising:

at least a first pair of piston chambers;

at least a first piston rod connecting a first pair of pistons at opposite ends of said at least a first piston rod, said first pair of pistons reciprocating within said first pair of piston chambers, said at least a first piston rod supported solely by said first pair of pistons, and said at least a first piston rod moving back and forth on the same axis;

a single bearing extending from and supported by said at least a first piston rod;

a rotating shaft;

a grooved end plate defining a groove which is off center with reference to said rotating shaft and not symmetrical with reference to said rotating shaft; and said rotating shaft connected so as to rotate said piston chambers and accordingly said first pair of pistons and said at least a first piston rod, said at least a first piston rod being perpendicular to said rotating shaft, said grooved end plate being perpendicular to said rotating shaft, and said groove being off center with respect to said rotating shaft;

said single bearing received in the groove such that, when rotational motion of the shaft rotates said at least a first piston rod around said shaft, each position of the bearing within the groove determines a corresponding position of said at least a first piston rod relative to the rotating shaft.

7. A compressor for moving a gas from an inlet to an outlet and providing a pressure differential between the inlet and the outlet, the compressor comprising:

a rotating shaft extending in a first direction through the compressor;

a first pair of piston chambers and a second pair of piston chambers;

a first piston rod extending through the compressor in a second direction substantially perpendicular to the rotating shaft, a first pair of pistons reciprocating within said first pair of piston chambers, said first piston rod connecting said first pair of pistons at opposite ends of said piston rod and supported solely by said first pair of pistons, wherein said piston rod slides back and forth relative to said rotating shaft such that said first pair of pistons are alternately closer to and farther from said rotating shaft; and a single first bearing extending from and supported by said first piston rod;

a second piston rod extending through the compressor in a third direction substantially perpendicular to the rotating shaft, a second pair of pistons reciprocating within said second pair of piston chambers, said second piston rod connecting said second pair of pistons at opposite ends of said second piston rod and supported solely by said second pair of pistons, wherein said second piston rod slides back and forth relative to said rotating shaft such that said second pair of pistons are alternately closer to and farther from said rotating shaft;

a single second bearing extending from and supported by said second piston rod; and a grooved end plate extending substantially parallel to said first and second piston rods and defining a single groove that receives said first and second bearings therein, wherein the groove within said grooved end plate is off-center with respect to said shaft and not symmetrical with reference to said rotating shaft;

said rotating shaft being connected so as to rotate either said piston chambers and accordingly said pistons and said piston rods or said grooved end plate;

wherein said first and second bearings traverse the groove when the rotational motion of the shaft rotates either said first and second piston rods or said grooved end plate around said shaft; and wherein each position of each respective first and second bearing within the groove determines a corresponding position of the respective first and second piston rod relative to the rotating shaft.

8. The compressor according to claim 7, wherein said piston rods define respective openings through which said rotating shaft extends.

9. The compressor according to claim 8, wherein said piston rods slide back and forth about the rotating shaft via the respective openings.

* * * * *